US005224523A

United States Patent [19]

Wardle

[11] Patent Number: 5,224,523

[45] Date of Patent: Jul. 6, 1993

[54] PADDLE WHEEL INERTING

[75] Inventor: David G. Wardle, Sutton, England

[73] Assignee: The BOC Group plc, Windlesham, England

[21] Appl. No.: 665,875

[22] Filed: Mar. 7, 1991

[30] Foreign Application Priority Data

Mar. 14, 1990 [GB] United Kingdom ..... 9005689

[51] Int. Cl.[5] ..... B67C 3/10

[52] U.S. Cl. ..... 141/4; 141/48; 141/67; 141/92; 141/144; 141/162; 141/236; 141/270

[58] Field of Search ..... 141/4, 5, 48, 67, 91, 141/92, 129, 141, 135, 136, 138, 144, 163, 234, 236, 237, 238, 240, 242-246, 250, 270, 283, 284, 85, 89, 93, 156, 157, 162; 222/132, 144, 167, 152; 422/28, 33, 302, 304

[56] References Cited

U.S. PATENT DOCUMENTS

| | | | |
|---|---|---|---|
| 1,066,285 | 7/1913 | Ketterer | 141/162 |
| 1,734,585 | 11/1929 | Ladewig et al. | 422/304 X |
| 1,833,028 | 11/1931 | Lindley | 141/162 |
| 1,965,246 | 7/1934 | Meyer | 141/39 |
| 2,014,750 | 9/1935 | Stegemann | 422/304 X |
| 2,267,744 | 12/1941 | Nordquist | 141/138 X |
| 2,691,477 | 10/1954 | Sabalauskas | 141/48 X |
| 2,964,071 | 12/1960 | Buell et al. | 141/162 |
| 3,154,117 | 10/1964 | Florin | 141/144 |
| 3,166,107 | 1/1965 | Swenson et al. | 141/236 X |
| 4,573,505 | 3/1986 | Lee et al. | 141/92 |
| 4,684,040 | 8/1987 | Jonovic et al. | 141/91 X |
| 4,862,696 | 9/1989 | Runkvist et al. | 141/67 X |

FOREIGN PATENT DOCUMENTS

| | | | |
|---|---|---|---|
| 1532522 | 8/1970 | Fed. Rep. of Germany . | |
| 2032702 | 11/1970 | France . | |
| 2290391 | 6/1976 | France . | |
| 1241643 | 8/1971 | United Kingdom . | |
| 2215712 | 9/1989 | United Kingdom | 141/67 |

*Primary Examiner*—Henry J. Recla
*Assistant Examiner*—Casey Jacyna
*Attorney, Agent, or Firm*—Larry R. Cassett

[57] ABSTRACT

A rotary apparatus for purging empty bottles with nitrogen gas includes a rotor from which arms of flexible material radiate. Each arm carries a gas supply lead. The arrangement is that advancing bottles engages the heads and thereby drive the rotor. Valve means is provided whereby each head in turn is placed in communication with a purging gas supply when it reaches a first position and the communication is ended when the head reaches the second position. During its course of travel from the first position to the second position, the head communicates with a respective bottle and the bottle is thereby purged.

9 Claims, 2 Drawing Sheets

PADDLE WHEEL INERTING

TECHNICAL FIELD

This invention relates to a method and apparatus for supplying gas. In particular, it relates to the supply of a non-oxidising gas, for example nitrogen, to flush or purge air from containers, particularly bottles, before the containers are charged with a liquid whose quality is liable to be impaired by oxidation. The method and apparatus according to the invention find particular utility in the bottling of alcoholic and non-alcoholic beverages.

BACKGROUND OF THE PRIOR ART

Modern bottling practice includes the step of loading bottles on a conveyer and advancing them, sometimes at rates up to 2000 bottles per minute, to a filling station where they are charged with a liquid, say a beverage. It is known that oxidation causes beverages such as beer to deteriorate. It is therefore desirable to minimise the contact between the beer and the oxygen of the atmosphere during bottling of the beer. It is therefore desirable to flush the empty bottles with a non-oxidising gas such as nitrogen so as to reduce the concentration of oxygen in the gaseous atmosphere they contain. Known proposals for performing this flushing step involve passing the bottles from the conveyer line to a station at which they can be flushed with nitrogen. The station normally comprises a carousel which receives bottles from a first line and returns the duly flushed bottles to a second line. This procedure has two disadvantages. First, the requirement for the carousel or other station at which the bottles can be flushed with nitrogen adds appreciably to the total capital cost of the bottling plant. Second, it increases the duration of the bottling procedure.

There is thus a need for a method and apparatus which may be used to flush the bottles with a suitable gas while they are being conveyed along a straight line path, and which preferably do not require a large capital expenditure. It is an aim of the present invention to provide an apparatus and a method that meet this need.

SUMMARY OF THE INVENTION

According to this invention, there is provided apparatus for flushing a line of advancing containers with gas comprising a multiplicity of spaced apart gas supply heads each engagable with a container and all able to be moved in concert along an endless path; and valve means operable to place each head in turn in communication with a main conduit when the head reaches a first chosen position along the path and to end such communication when the head reaches a second chosen position, whereby in use each container in turn is able to be engaged by a respective head and flushed with gas.

The invention also provides a method of flushing a line of advancing containers with gas comprising advancing a multiplicity of spaced apart gas supply heads, each engagable with a container, along an endless path such that each head in turn engages an advancing container and each advancing container in the sequence is engaged by a head, and supplying gas to each head when it is between chosen positions only, such positions including those in which it is in engagement with a container, and thereby flushing the containers with gas.

Preferably, the heads are attached to a rotor which is mounted on a fixed shaft whereby the advancing containers are able to drive the rotor and cause each head in turn to engage a respective container and each container in turn to be engaged by a respective head. An alternative is to provide a separate drive for the rotor, in which instances the shaft may turn with the rotor. However, providing a separate drive adds to the cost of the apparatus according to the invention and problems may arise in synchronising the speed of rotation of the rotor to the speed at which the containers advance. By employing the containers themselves to drive the rotor, and appropriately selecting the number and spacing of the heads, continuous rotation of the heads by the line of containers is made possible.

In an embodiment of the apparatus according to the invention in which there is a rotor mounted on a fixed shaft, the rotor preferably co-operates with a complementary stationary member ('the stator') to define the valve means. In such an arrangement, one of the stator and the rotor defines a circumferential chamber in communication with an inlet for the flushing gas, while the other of the stator and the rotor defines a ring of outlet ports, each in communication with a respective head, the arrangement being such that rotation of the rotor brings each outlet port in turn into communication with the chamber and hence the inlet. The extent of the chamber is preferably such that it overlaps and hence communicates with typically three or four gas ports. This enables each head in turn to be supplied with nitrogen (or other flushing gas) as it enters into alignment with a container. The contiguous faces of the stator and rotor are preferably formed such that there is a narrow gap and hence gas layer therebetween (say no more than one or two 'thou', i.e. in the order of 0.01 to 0.03 mm).

The containers are typically bottles or other members which are each formed with a neck such that the internal diameter of their mouth is markedly less than the internal diameter of their body.

The heads are preferably connected to the rotor by means of flexible arms. The arms are preferably made of flexible material, for example, plastics. It is possible to provide conduits communicating with the outlet ports (if in the rotor) through the arms themselves. Alternatively, and more preferably, there are separate conduits connecting each head with a respective port in the valve.

Each head preferably takes the form of a cap having a slot in the rear side thereof. It is not necessary and indeed not preferred for there to be any close match between the shape of the cap and that of the top of the bottle. In operation, the bottle engages the inner surface of the forward side of the cap (with respect to the direction of rotation of the heads) and thereby acts to push the rotor so as to advance each head continuously along the endless path. The rearward slot facilitates engagement of the cap with the top of the bottle.

BRIEF DESCRIPTION OF THE DRAWINGS

A method and apparatus according to the invention will now be described by way of example with reference to the accompanying drawings, in which.

The drawings are not to scale.

DETAILED DESCRIPTION OF THE INVENTION

Figure 1:
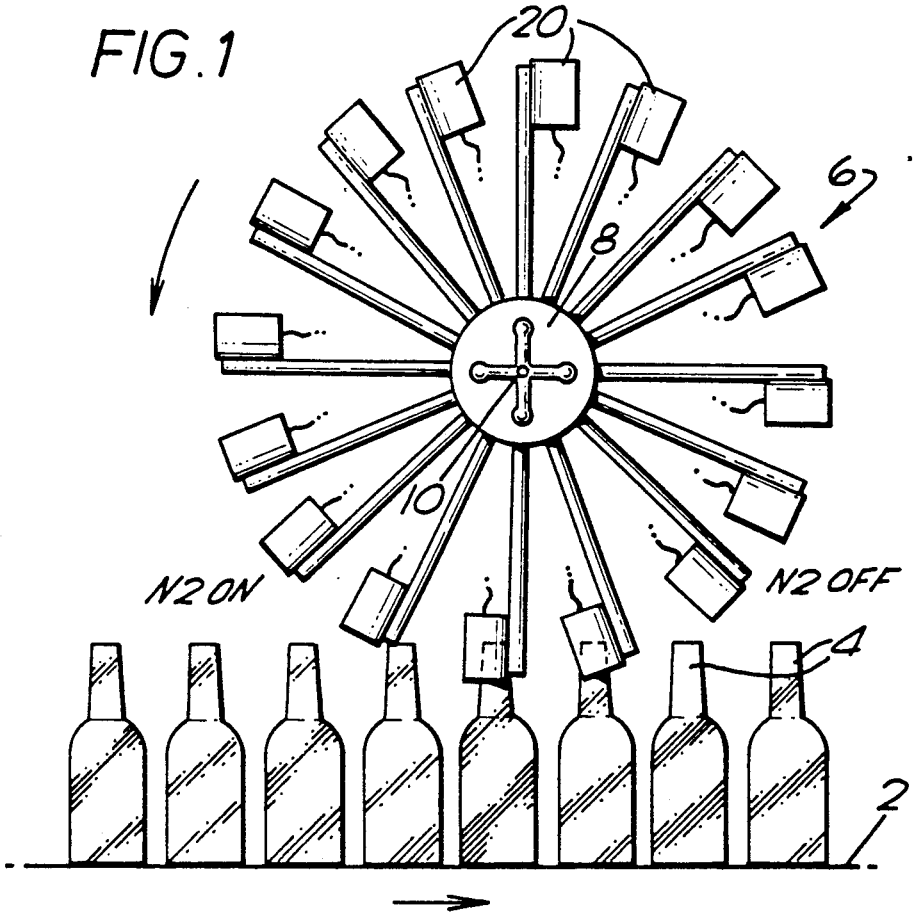
FIG. 1 is a schematic diagram giving a general view from the side of an apparatus according to the invention.
Figure 2:
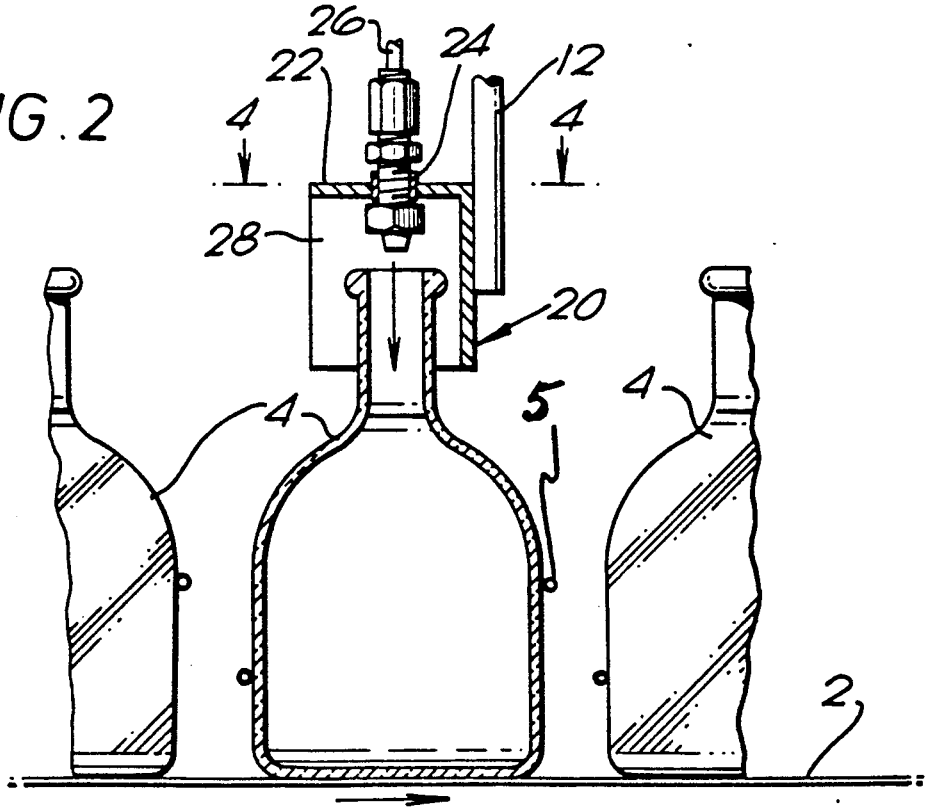
FIG. 2 shows a detail of the apparatus shown in FIG. 1.

Referring to FIG. 1 of the drawings, there is shown part of a conveyer 2 which advances a row of bottles 4 to a filling station where the bottles are charged with a beverage. As shown in FIG. 2 the bottles are retained in position on the conveyer 2 by retaining means 5. Referring again to FIG. 1, located above the conveyer 2 is a rotary gas purging apparatus 6. The apparatus 6 includes a rotor B which is axially mounted on a shaft 10. Arms 12 of flexible material radiate from the rotor 8 like spokes from the hub of a wheel. As shown in FIG. 1, there are sixteen arms 12. Fewer or more arms may be used. In practice, the main factors determining the number of arms required will be the spacing between the individual bottles and the length of the arms. Generally, the closer the spacing between neighbouring bottles on the conveyer 2 and the longer the arms 12, the more arms 12 will be required.

The arms 12 each carry a head (not shown in FIG. 1). Each head communicates with a source of nitrogen or other purging or flushing gas by means of suitable tubing (not shown in FIG. 1).

Figure 3:
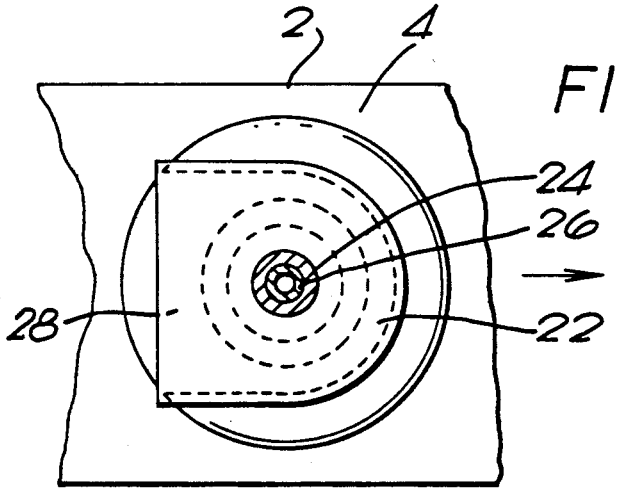
FIG. 3 is a sectional view of a gas flushing head.

The heads are illustrated in FIGS. 2 and 3 of the drawings. These Figures show the heads 20 each connected to the rearward side of a respective arm 12 (having regard to the anti-clockwise direction of rotation of the arms 12). Any suitable connecting means such as rivets or bolts may be used for this purpose. Each head 20 comprises a cap 22 having a gas introduction nozzle 24 in its top. The nozzle 24 receives a length of tubing 26 which extends from the rotor 8 in a manner that will be described below. Each head 20 has a slot 28 formed in its rearward side through which in operation the tops of the bottles 4 may pass.

In operation, at the start of a filling operation, the conveyer 2 shown in FIG. 1 is started and the first bottle in the line passes through the slot 28 of the head 20 connected to the arm 12 which is in the 6 o'clock position (i.e. pointing vertically downwards). The bottle continues to advance and as it does so, so it turns the assembly of the rotor 8, arms 12 and heads 20 in an anti-clockwise direction. Accordingly, the head that is immediately behind the one engaging the bottle moves through an arcuate path with a horizontal component of velocity less than the velocity at which the bottles are advanced, with the result that by the time the next bottle 4 reaches the 6 o'clock position it has caught the next head 12. Moreover, as the first bottle proceeds towards the filling station (not shown) so it continues to push the assembly of rotor 4, arms 12 and heads 20 in an anti-clockwise direction until the arcuate path followed by the heads 20 causes the respective head 20 to move out of engagement with the leading bottle 4. By this time the next bottle has reached the 6 o'clock position as described above. Accordingly, continuous rotation of the assembly of rotor 8, arms 12 and heads 20 is made possible with each head 20 in turn being engaged by the top of a bottle 4 and each bottle 4 in turn engaging a respective head 20. The retaining means 5 resist any tendency for the bottles to be knocked over by their contact with the arms 12 of the gas flushing apparatus 6.

Figure 4:
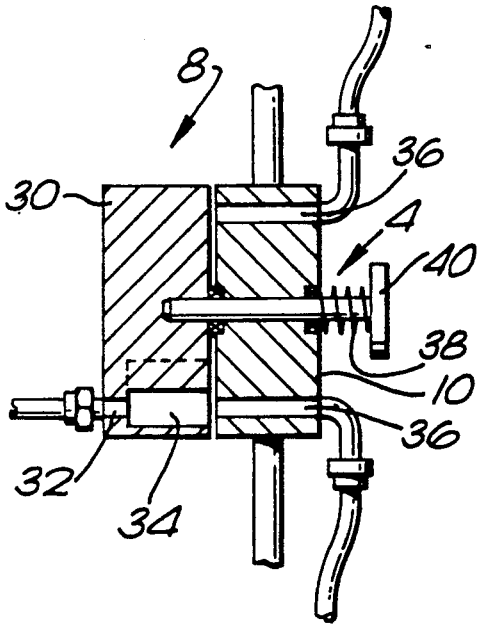
FIG. 4 is a sectional elevation of valve for use in association with the apparatus shown in FIGS. 1 to 3.
Figure 5:
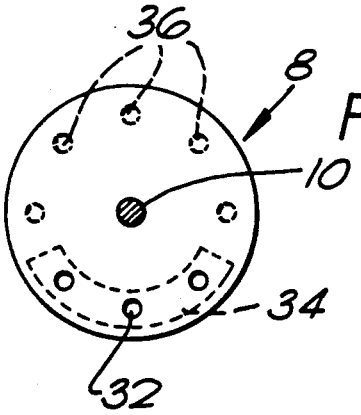
FIG. 5 is a schematic plan view of the rotary element of the valve shown in FIG. 4.

The arrangement whereby gas such as nitrogen is used to flush the bottles is shown in FIGS. 4 and 5 of the accompanying drawings. Referring to FIG. 4, the rotor mounted on the shaft 10 co-operates with a complementary stationary member or stator 30 which is axially and fixedly mounted on the shaft 10. The stator 30 has an inlet port 32 for gas. The inlet port 32 may communicate by means of a conduit (not shown in FIGS. 4 and 5) with a conduit communicating with a source of nitrogen. The port 32 at its inner end terminates in an arcuate chamber 34 which is formed as an arcuate slot in the inner face of the stator 30. The rotor 8 has a number of equally spaced circumferentially disposed ports 36 formed therethrough. As shown in FIG. 5, the chamber 34 has its mid-point in the 6 o'clock position. As the rotor 8 is caused to rotate by the forward motion of the bottles, so each port 36 in turn comes into registry with the centre of the chamber 34. Preferably the extent of the chamber 34 is such that when one port is in the 6 o'clock position, the chamber 34 overlaps two other ports one on either side of the 6 o'clock port. The ports 36 are each connected to a respective conduit 26 that provides gas flow to a respective head 20 of the apparatus 6. Accordingly, it can be arranged that the three ports 36 overlapped at any one time by the chamber 34 and hence put in communication with the inlet port 32, and thus the source of nitrogen supply, are the ones that serve the head 20 for the time being in the 6 o'clock position and the two neighbouring head on each respective side.

Accordingly, the supply of nitrogen to each head 20 starts before the head is in precise alignment with the bottle. Similarly, nitrogen will also be supplied to the head as it passes beyond the 6 o'clock position. There is accordingly a period of travel of the head on either side the 6 o'clock position during which nitrogen is supplied to the bottle. Desirably, the flow rate of nitrogen is arranged so that the bottle receives at least twice and preferably three times its own volume of nitrogen. The arrangement is also such that once the head has moved away from a bottle that has advanced sufficiently beyond the 6 o'clock position, the port 36 placing that head in communication with the source of nitrogen via the port 32 and the chamber 34 has passed out of registry with the chamber 34 so that substantially no nitrogen is received by that port. Accordingly, wastage of nitrogen is kept to a minimum.

In order to keep the contiguous faces of the rotor 8 and stator 30 in proximity to one another, the rotor 8 is biased by a compression spring 38 into engagement with the stator. A boss 40 may be provided on the shaft 10 to enable the spring pressure to be adjusted manually.

Another feature of the valve arrangement shown in FIGS. 4 and 5 of the drawings is that a very shallow recess or gap is provided between the contiguous facing surfaces of the stator 30 and rotor B to provide for a gas bearing therebetween. There will accordingly be some leakage of gas into those ports 36 not for the time being in registry with the chamber 34, but such gas loss will be minimal in comparison with that which is supplied to the bottles.

I claim:

1. Apparatus for flushing a line of advancing containers with gas comprising a multiplicity of spaced-apart gas supply heads in a vertical plane each engagable with a container and all able to be moved in concert along an endless path; and valve means operable to place each head in turn in communication with a main conduit when the head reaches a first chosen position along the path and to end such communication when the head reaches a second chosen position, whereby in use each container in turn is able to be engaged by a respective head and flushed with gas, wherein the heads are attached to a rotor which is mounted on a fixed shaft whereby the advancing containers are able to drive the rotor and cause each head in turn to engage a respective container and each container in turn to be engaged by a respective head.

2. Apparatus as claimed in claim 1, wherein the rotor co-operates with a complementary stationary member ('the stator') to define the valve means, one of the stator and the rotor defining a circumferential chamber in communication with an inlet for the flushing gas, and the other of the stator and the rotor defining a ring of outlet ports, each in communication with a respective head, the arrangement being such that rotation of the rotor brings each outlet port in turn into communication with the chamber and hence the inlet.

3. Apparatus as claimed in claim 2, wherein the chamber at any one time overlaps and hence communicates with three or four gas ports.

4. Apparatus as claimed in claim 2, wherein the contiguous faces of the stator and rotor are formed such that there is a narrow gap and hence gas layer therebetween.

5. Apparatus as claimed in claim 2, in which the heads are connected to the rotor by means of flexible arms.

6. Apparatus as claimed in claim 5, wherein there is a respective conduit separate from the arms which connects each head with a respective port in the said valve.

7. Apparatus as claimed in claim 2, wherein each head takes the form of a cap having a slot in the rear side thereof.

8. A method of flushing a line of advancing containers with gas comprising advancing a multiplicity of spaced apart gas supply heads in a vertical plane, each engagable with a container, along an endless path such that each head in turn engages an advancing container and each advancing container in the sequence is engaged by a head, and supplying gas to each head when it is between chosen positions only, such positions including those in which it is in engagement with a container, and thereby flushing the containers with gas, wherein the heads are attached to a rotor which is mounted on a fixed shaft whereby the advancing containers are able to drive the rotor and cause each head in turn to engage a respective container and each container in turn to be engaged by a respective head.

9. A method as claimed in claim 8, wherein the containers are bottles.

* * * * *